United States Patent [19]

Gomez et al.

[11] 4,212,927

[45] Jul. 15, 1980

[54] PROCESS FOR PREPARING ARTIFICIAL LEATHER COMPOSITE

[75] Inventors: Daniel Gomez; Giampaolo Bartoli, both of Le Guillermet, France

[73] Assignee: Arjomari-Prioux, France

[21] Appl. No.: 859,871

[22] Filed: Dec. 12, 1977

[30] Foreign Application Priority Data

Dec. 17, 1976 [FR] France ..... 76 38197

[51] Int. Cl.[2] ..... B05D 1/18; B05D 3/02; B32B 23/08; B32D 27/10

[52] U.S. Cl. ..... 428/512; 427/411; 427/439; 427/389.9; 428/513; 428/514; 428/515; 428/904

[58] Field of Search ..... 427/390 R, 411, 244, 427/245, 439; 162/168 R, 168 NA, 169; 428/904, 511, 512, 513, 514, 515, 520

[56] References Cited

U.S. PATENT DOCUMENTS

| | | | |
|---|---|---|---|
| 3,307,965 | 3/1967 | Seifer et al. | 428/514 X |
| 3,423,232 | 1/1969 | Reinhard et al. | 428/514 |
| 3,481,767 | 12/1969 | Craven et al. | 428/904 X |
| 3,507,691 | 4/1970 | Weber et al. | 162/169 |
| 3,574,021 | 4/1971 | Van Buskirk | 428/904 X |
| 3,671,375 | 6/1972 | Van Buskirk | 428/904 X |
| 3,707,393 | 12/1972 | McDonald | 427/411 X |
| 3,812,006 | 5/1974 | Schertmann et al. | 162/169 X |

*Primary Examiner*—Michael R. Lusignan
*Attorney, Agent, or Firm*—Staas & Halsey

[57] ABSTRACT

The present invention relates to a process for manufacturing an artificial leather composite material, and comprises:

(i) a cellulosic fibrous mass bound by means of a binding agent, and impregnated by means of at least one acrylic polymer or copolymer, (ii) an intermediate pore-blocking layer comprising at least one vinylic polymer or copolymer, and (iii) a finishing layer comprising at least one vinylic polymer or copolymer and at least one coalescence agent.

13 Claims, No Drawings

PROCESS FOR PREPARING ARTIFICIAL LEATHER COMPOSITE

BACKGROUND OF THE INVENTION

The present invention relates, as novel industrial product, to a process for manufacturing an artificial leather composite material capable of replacing leather and endowed with excellent mechanical properties and fabricated, according to paper-making techniques, from a support comprising cellulosic fibres.

A large variety of products intended to imitate leather and manufactured by various techniques is known to exist at present. However, all these products are far from being perfect from the aesthetic point of view, and, in addition, they prove particularly difficult to manufacture.

To prepare these products, several technical solutions have been proposed for solving the problem of obtaining a material for replacing leather, (i.e. artificial or imitation leather).

According to one of these solutions, a cellulosic textile support (woven or non-woven) is impregnated and then coated on the surface, (by direct coating or by transfer), with resins (particularly cellulosic, acrylic, vinylic resins or resins of the polyurethane type) in solutions of inflammable and/or toxic solvents (particularly benzene, toluene, xylene, methylethylketone, dimethylformamide, tetrahydrofuran and ethyl acetate, etc . . . ). Unfortunately, such a technique requires the use of complicated installations which involve considerable operating costs with respect to the very strict rules of hygiene and safety.

To prepare the vinylic leathers which exist on the market, a technical solution which is relatively close to the preceding one is employed, which consists of using a resin of vinyl chloride polymers or copolymers, a large quantity of plasticizers (45 to 120% by weight of plasticizer, such as dioctylphthalate and butylbenzylphthalate, with respect to the weight of the resin), and solvents, acting as diluents, such as xylene.

Furthermore, according to French Pat. No. 1 397 666, another technical solution has been proposed which consists of treating a support surface composed at least in part of a mixture of rubber, with a grafted polymer (prepared from an acrylic monomer and a rubber) to form an intermediate layer, and then creating an aqueous suspension of a polymer to form the outer layer.

Another technical solution described in French Pat. No. 2 246 684 consists of applying on a support (textile, leather or split leather) a dispersion of polymers and vulcanisation agents, then applying heat for coagulating said dispersion.

SUMMARY OF THE INVENTION

To solve the technical problem of preparing a material to replace leather, an original solution is recommended according to the invention, which is different from that of the prior art and which comprises the treatment of a support comprising cellulosic fibres with aqueous baths (suspensions and/or dispersions) according to paper-making techniques. In this way, the technical solution according to the invention uses conventional paper-making and coating means such as a machine with a flat, inclined or vertical table, size-press, Champion doctor, air blade, trailing blade or roll coater.

One of the objects of the invention is to obtain a supple material of pleasant appearance, which may be used to replace leather, and having excellent mechanical properties, particularly resistance to dry and wet abrasion, to friction, perspiration, folding, creasing, tearing, pulling, splitting, peeling, as well as a good impermeability to water and grease.

The process for preparing a material for decoration, coating and finishing, which may be used to replace natural leather and is endowed with excellent mechanical properties, in which a support comprising cellulosic fibres is treated according to a paper-making technique, by means of an aqueous dispersion or suspension of a macromolecular substance, is characterised by the following successive steps of:

(a) introducing into the fibrous support an aqueous dispersion of at least one binding agent, (b) impregnating the fibrous support thus treated by means of an aqueous bath containing at least one macromolecular substance chosen from the group constituted by the acrylic polymers and copolymers, (c) coating the support thus treated by means of an aqueous bath containing at least one macromolecular substance chosen from the group constituted by the vinylic and acrylic polymers and copolymers, to obtain an intermediate layer, (d) subjecting the material thus obtained to a coating by means of an aqueous bath containing at least one macromolecular substance chosen from the group constituted by the vinylic and acrylic polymers and copolymers, and at least one coalescence agent, to obtain a so-called finishing layer, and, if necessary, subjecting the resulting product to at least one mechanical treatment, particularly to give it the desired appearance.

The fibrous support of stage (a) may be constituted wholly or partly by cellulosic fibres. A mixture of cellulosic fibres with synthetic fibres may thus be used. However, purely cellulosic fibres will preferably be used, particularly those coming from paper pulp.

The expression "acrylic polymers and copolymers" is understood here to mean the macromolecular substances obtained from at least one acrylic monomer such as acrylic acid, methacrylic acid, acrylates and methacrylates of lower alkyl with 1–4 C atoms, acrylamide, methacrylamide, acrylonitrile, methacrylonitrile and N-methylolacrylamide.

The expression "vinylic polymers and copolymers" is understood here to mean the macromolecular substances obtained from at least one vinylic monomer such as vinyl chloride and vinylidene chloride.

Taking these definitions into account, the acrylic polymers and copolymers comprise the polyacrylic and polymethacrylic acids, polyacrylates, polyacrylamides, polyacrylonitriles and copolymers (where the acrylic units are preponderant) of the type acrylate-acrylonitrile, acrylic acid-acrylonitrile, acrylate-acrylonitrile-butadiene, acrylonitrile-styrene, acrylate-acrylonitrile-N-methylolacrylamide; and the vinylic polymers and copolymers comprise polyvinyl chloride and the copolymers (where the vinyl units are preponderant) obtained from vinyl chloride. Of course, the acrylic copolymers may, if necessary, comprise vinylic units and, inversely, the vinylic copolymers may, if necessary, comprise acrylic units.

Copolymers A–D may be cited in particular by way of non-limiting example, which are obtained from the monomers or the formulations given hereinafter:

| | |
|---|---|
| Copolymer A | |
| ("acrylic" copolymer) | |
| ethyl acrylate | 87 to 98 parts by weight |
| acrylonitrile | 1 to 8 parts by weight |
| N-methylolacrylamide | 1 to 6 parts by weight |
| acrylic acid | 1 to 6 parts by weight |
| Copolymer B | |
| ("acrylic" copolymer) | |
| ethyl acrylate | 60 to 75 parts by weight |
| acrylonitrile | 5 to 15 parts by weight |
| butyl acrylate | 10 to 20 parts by weight |
| N-methylolacrylamide | 1 to 6 parts by weight |
| acrylamide | 1 to 6 parts by weight |
| Copolymer C | |
| ("vinylic" copolymer) | |
| vinyl chloride | 70 to 90 parts by weight |
| methyl acrylate | 10 to 30 parts by weight |
| Copolymer D | |
| (plasticized "vinylic" copolymer) | |
| vinyl chloride-methyl acrylate copolymer (in a mass ratio (70–90:30–10)) | 100 parts by weight |
| plasticizer (diisooctylphthalate) | 30 to 40 parts by weight |

Stage (a) concerns the introduction of the binding agent in the mass of the fibres. The binding agent may be one of the binding agents used currently in the paper-making industry. An acrylic polymer or copolymer as defined hereinabove will advantageously be used.

According to a feature of the invention, the aqueous suspension or dispersion of stage (a) containing the binding agent, further comprises at least one additive chosen from dyes, retention agents, lubricating agents, gluing agents, anti-foam agents, perfumes and pH adjusting agents. Said suspension or dispersion will advantageously contain with the binding agent, at least one retention agent, at least one lubricating agent, at least one anti-foam agent, and at least one pH adjusting agent. It may in addition contain at least one colouring agent, and optionally may contain a perfume, for example, a hydrosoluble perfume.

Among the retention agents which may be used, the agents for the cationisation of the fibres (to render them substantive) may be, for example: polyamine, polyamide and polyethyleneimine resins, and polymers such as polyacrylic acids, polyacrylamides, styrene-butadiene, butadiene-acrylonitrile copolymers. The quantity of retention agent to be used will generally be vary small and of the order of 0.1 to 1 part by weight for 100 parts by weight of fibres to be treated.

The lubricating agents are substances well known in the art. The following are examples of lubricating agents which may be used: sulfonated oils, glycol derivatives and stearates of calcium and ammonium.

Aluminium chloride and aluminium sulphate may be used as pH adjusting agents.

The dyes to be used may be direct, acid, basic and pigmentary dyes.

The gluing agents which may be used in stage (a) are particularly those mentioned hereinafter for stage (b).

Stage (b) deals with the impregnation of the support of the sheet form obtained in stage (a). The aqueous bath of stage (b) contains a suspension or dispersion of an acrylic polymer or copolymer as defined hereinabove.

According to a further feature of the invention, the aqueous impregnating bath of stage (b) comprises said polymer or copolymer and at least one additive chosen in particular from the group constituted by the gluing agents, dyes and anti-foam agents. The bath of stage (b) will advantageously contain with the acrylic polymer or copolymer at least one gluing agent, and at least one anti-foam agent. It may also contain at least one dye.

Among the gluing agents which may be used, the following may be particularly mentioned: the anhydrides of dicarboxylic acids, dimeric alkylketenes and paraffin emulsions. The presence of a gluing agent at stage (b) has for its purpose to reduce the hydrophily of the material obtained.

The addition of one or more dyes enables a better vividness and uniformity of the shade to be obtained.

According to the invention, it is unnecessary to add to the bath of stage (b) a heat-sensitizing agent such as ZnO to promote the vulcanisation of the polymer or copolymer.

Stage (c) concerns the formation of an intermediate, so-called "pore-blocking" layer, so as to reduce the superficial microporosity and to reinforce the gluing of the substrate, a condition indispensable for the final decorative coating of stage (d) to remain as much as possible on the surface.

The aqueous coating bath of stage (c) contains a suspension or dispersion of a vinylic or acrylic polymer or copolymer, as defined hereinabove.

According to another feature of the invention, the aqueous bath of stage (c) comprises at least one vinylic polymer or copolymer, and at least one additive chosen in particular from the group constituted by the mineral fillers, anti-foam agents, dyes and gluing agents. The aqueous bath of stage (c) will advantageously contain a vinylic polymer or copolymer and at least one mineral filler. It may also contain at least one dye, and possibly at least one gluing agent similar to that of stage (b).

The coating of stage (d) deals with obtaining a so-called "finishing" layer; it is this latter layer which, after subsequent mechanical treatment, will contribute to giving the desired appearance.

The aqueous coating bath of stage (d) contains a suspension or dispersion of a vinylic or acrylic polymer or copolymer, and at least one coalescence agent.

Among the suitable coalescence agents, the following may be mentioned in particular: the ethers and esters of ethyleneglycol, and in particular, the following products: diethyleneglycol monoethylether (which corresponds to the systematic nomenclature of 2-(2-ethoxyethoxy)-ethanol), the acetate of ethyleneglycol monobutylether (which corresponds to the systematic nomenclature of 2-butoxyethyl acetate), the acetate of diethyleneglycol monobutylether (which corresponds to the systematic nomenclature of 2-(2-butoxyethoxy)ethyl acetate), and their analogues.

According to another feature of the invention, the aqueous bath of stage (d) comprises at least one vinylic polymer or copolymer, at least one coalescence agent, and at least one additive chosen in particular from the group constituted by the opaquing agents, matting or dulling agents, lubricating agents, anti-foam agents, dyes and perfumes. The aqueous coating bath of stage (d) will advantageously contain at least one vinylic polymer or copolymer, at least one coalescence agent, at least one lubricating agent, at least one anti-foam agent, at least one opaquing agent, at least one matting agent and if necessary at least one colouring agent and at least one perfume.

The lubricating agent of stage (d) is an agent similar to the lubricating agents of stage (a). The opaquing agents and the matting agents are particular fillers. Titanium oxide may be used as opaquing agent and calcium carbonate and silica, particularly colloidal silica, may be used as matting agent.

The material obtain in stage (d) may be subjected to one or more mechanical treatments.

This material may, if desired, by calendered or grained. Embossing may be effected with different types of grains (for example small crushed grains, coarse grains, cloth grain, etc . . . ). It may also be printed in one or more colours, by single-colour printing, by printing solely on the crest of the grain, by printing of the trough, or the two combined, if the product is grained, which gives a better imitation of the skin, two-colour effects, etc . . . .

According to an important feature of the invention, the material is crumpled to give it an appearance of old leather after possibly having grained it. It may be advantageous to press the material after having creased it and, according to the case, repeat several crumpling and pressing cycles.

This material has a good aptitude to creasing, to cold gilding, reacts well upon repinching and to the cold test.

DESCRIPTION OF THE PREFERRED EMBODIMENTS

The best mode of carrying out the invention has been given hereinbelow:

Stage (a)

A binding agent which is in aqueous suspension at 250–550 g/l is introduced at ambient temperature (15°–25° C.) in the cellulosic fibrous mass. For 100 parts by weight of fibres to be treated, the aqueous suspension of said binding agent contains the following additives:

| | |
|---|---|
| dye | 0.5 to 5 parts by weight |
| retention agent | 0.1 to 1 part by weight |
| lubricating agent | 0.5 to 5 parts by weight |
| anti-foam agent | 0.1 to 0.5 part by weight |
| pH adjusting agent | 0.1 to 4 part by weight |

The fibres are at a pH between 5 and 7 and the minimum duration of contact between the fibres and the aqueous suspension of the binding agent is of the order of 15 to 30 seconds. The binding agent used is an acrylic polymer or copolymer (latex), and preferably copolymer A. After elimination of the water, a sheet is obtained which contains, for 100 parts by dry weight of fibres, 5 to 30 parts by dry weight of products.

Stage (b)

The sheet obtained in stage (a) is impregnated by means of an aqueous bath containing 250 to 550 g/l of an acrylic polymer or copolymer (preferably copolymer A or copolymer B).

The impregnation bath which is at a pH of between 4.5 and 10, and at a temperature between 20° and 60° C., contains the following ingredients:

| | |
|---|---|
| acrylic polymer or copolymer | 100 parts by weight |
| gluing agent | 0.5 to 12 parts by weight |
| dye | 1 to 10 parts by weight |
| anti-foam agent | 0.1 to 0.5 part by weight |

Drying is effected. The quantity of products deposited during stage (b) is of the order of 5 to 25 parts by weight for 100 parts by dry weight of sheet (a) to be treated.

Stage (c)

The sheet obtained in stage (b) is coated by means of an aqueous bath (dispersion or suspension) containing 250 to 550 g/l of a vinylic polymer or copolymer (preferably copolymer D).

The coating bath which is at a pH of between 4.5 and 10 and at a temperature of between 20° and 60° C., contains the following ingredients:

| | |
|---|---|
| vinylic polymer or copolymer | 100 parts by weight |
| mineral filler | 25 to 85 parts by weight |
| dye | 1 to 10 parts by weight |

Drying is effected. The quantity of products deposited during stage (c) is of the order of 5 to 10 parts by dry weight for 100 parts by weight of sheet (b) to be treated.

Stage (d)

The sheet obtained in stage (c) is coated by means of an aqueous bath (dispersion or suspension) containing 250 to 550 g/l of an acrylic polymer or copolymer (preferably a mixture of copolymers C and D).

The aqueous bath which is at a pH of between 4.5 and 10 and at a temperature of between 20° and 60° C. contains the following ingredients:

| | |
|---|---|
| vinylic polymer or copolymer | 100 parts by weight |
| coalescence agent | 0.1 to 1 part by weight |
| opaquing agent | 0.2 to 10 parts by weight |
| matting agent | 1 to 15 parts by weight |
| dye | 1 to 15 parts by weight |
| anti-foam agent | 0.1 to 0.5 part by weight |
| lubricating agent | 2 to 10 part by weight |
| perfume | 0 to 1 part by weight |

Drying is effected. The quantity of products deposited during stage (d) is of the order of 5 to 25 parts by dry weight for 100 parts by weight of sheet (c) to be treated.

Generally, in stage (a), 1 to 4 tons of fibre can be treated per hour; in stage (b), 1 to 4 tons of material (a) per hour; in stage (c) 1 to 4 tons of material (b) per hour, and in stage (d), 2 to 6 tons of material (c) per hour.

The preferred material for decoration, coating, protecting and shaping, particularly useful as a replacement for leather, according to the invention, is characterised in that it comprises:

(i) a cellulosic fibrous mass bound by means of a binding agent, and impregnated by means of at least one acrylic polymer or copolymer, (ii) an intermediate pore-blocking layer comprising at least one vinylic polymer or copolymer and (iii) a finishing layer comprising at least one vinylic polymer or copolymer and at least one coalescence agent.

This material may be used in particular for replacing leather in certain applications, such as in book-binding, the fancy leather industry, clothing industry, shoes, furnishings and car interior linings. This washable material may also be employed as wall hangings, as decorative material, which is very resistant, imitating different types of materials such as cork, wood, jute, these various appearances being obtained by printing with corresponding decorations.

The excellent mechanical characteristics and the impermeability also make it possible to use the material according to the invention as a cover such as a tarpaulin, etc . . . ; this material may also be shaped as a fabric, a non-woven fabric, fancy leather goods etc . . . , as the sewing threads cannot cut the material; consequently, the seams cannot open. This feature, together with the tightness of the material, allows the most varied shapings in the domain of the fancy leather industry, shoe manufacture and packing or coating products which cannot be used as is, but require pieces to be cut out and assembled.

Since the visible layer of the material is heat-weldable, it is possible to shape it or glue it.

The invention will be more readily understood on reading the following non-limiting examples which have been given by way of illustration only.

EXAMPLE 1

Stage (a)

A binding agent (copolymer A) in aqueous suspension at about 500 g/l is introduced into a mass of 100% cellulosic fibres, said aqueous solution further containing the following additives for 100 parts by weight of fibres to be treated:

| | |
|---|---|
| dye (direct or acid) | 0.5 to 5 parts by weight |
| retention agent | 0.1 to 1 part by weight |
| lubricating agent | 0.5 to 5 parts by weight |
| anti-foam agent | 0.3 part by weight |
| aluminium sulphate | 0.1 to 4 parts by weight |

A support is obtained whose weight per surface unit is between 120 and 180 g/m$^2$.

Stage (b)

The preceding support is impregnated with an aqueous bath of acrylic latex (copolymer B) at about 500 g/l, at a temperature of between 20° and 60° C. The composition of the ingredients contained in the impregnation bath is as follows:

| | |
|---|---|
| copolymer B | 100 parts by weight, |
| gluing agent (rosin resin-paraffin) | 0.5 to 12 parts by weight |
| dye (direct or acid) | 1 to 10 parts by weight |
| anti-foam agent | 0.1 to 0.5 parts by weight |

The absorption of dry matter is from 20 to 30 g/m$^2$.

Stage (c)

The preceding support is coated with an aqueous bath containing 500 g/l of vinylic copolymer (copolymer D), at 20°–60° C. The composition of the ingredients contained in the aqueous bath is as follows:

| | |
|---|---|
| copolymer D | 100 parts by weight |
| kaolin | 25 to 85 parts by weight |
| dye (direct or acid) | 1 to 10 parts by weight |
| Drying is effected. | |

Stage (d)

The preceding support is coated by means of an aqueous bath containing an acrylic copolymer (mixture of copolymers C and D) at a temperature of between 20° and 60° C. The composition of the aqueous coating bath is as follows:

| | |
|---|---|
| mixture of copolymer C (vinyl chloride - methyl acrylate (70–90 : 30–10) by weight and of copolymer D in the mass ratio (3:10) | 100 parts by weight |
| diethyleneglycol monethylether | 0.1 to 1 part by weight |
| opaquing agent ($TiO_2$) | 0.2 to 10 parts by weight |
| matting agent ($CaCO_3$) | 1 to 15 parts by weight |
| anti-foam agent | 0.2 parts by weight |
| lubricating agent (stearate of calcium or ammonium) | 2 parts by weight |
| dye (pigmentary) | 3 parts by weight |

EXAMPLE 2

The support obtained in stage (a) of Example 1 is impregnated with an aqueous suspension at 500 g/l of the copolymer B. The aqueous impregnation bath which has a pH adjusted between 6 and 8 by means of ammonia and is at a temperature of between 20° and 60° C., comprises the following ingredients:

| | |
|---|---|
| copolymer A | 100 parts by weight |
| gluing agent (dimeric alkylketene) | 3 parts by weight |
| dye | 1 to 10 parts by weight |
| anti-foam agent | 0.3 parts by weight |

The support thus impregnated receives the pore-blocking layer then the finishing layer according to the process described in stages (c) and (d) of Example 1.

EXAMPLE 3

Stage (b)

The support obtained in stage (a) of Example 1 is impregnated by means of an aqueous bath of vinylic copolymer at 500 g/l. The aqueous bath which has a pH of between 4.5 and 10 and is at a temperature of between 20° and 60° C., comprises the following ingredients:

| | |
|---|---|
| copolymer B | 100 parts by weight |
| gluing agent | 10 parts by weight |
| dye | 1 to 10 parts by weight |
| anti-foam agent | 0.1 to 0.5 parts by weight |

The absorption of the dry matter is of the order of 20 to 30 g/m$^2$.

Stage (c)

The pore-blocking layer is made by coating the support obtained in stage (b) hereinabove, by means of a vinylic copolymer in aqueous suspension at 500 g/l. The aqueous coating bath which has a pH of between 4.5 and 10 and is at a temperature between 20° and 60° C. comprises the following ingredients:

| | |
|---|---|
| copolymer D | 100 parts by weight |
| kaolin | 30 parts by weight |
| dye | 1 to 10 parts by weight |

Stage (d)

The finishing layer is made by coating the support obtained in stage (c) hereinabove, by means of an aqueous bath (at pH 4.5–10 and at a temperature of between 20° and 60° C.) of a vinylic copolymer at 500 g/l. The composition of said aqueous bath is as follows:

| | |
|---|---|
| mixture of copolymer C (vinyl chloride-methyl acrylate (70–90 : 30–10) by weight) and of copolymer D in the mass ratio (3:10) | 100 parts by weight |
| acetate of diethyleneglycol monobutylether | 1 part by weight |
| opaquing agent ($TiO_2$) | 3 parts by weight |
| matting agent (colloidal silica) | 5 parts by weight |
| anti-foam agent | 0.2 part by weight |
| dyes (pigmentary) | 3 parts by weight |
| lubricating agent (stearate of calcium or ammonium) | 2 parts by weight |
| hydrosoluble perfume (leather) | 0.5 part by weight |

EXAMPLE 4

The finishing layer of the support obtained in stage (c) of Example 3 is produced by means of an aqueous coating bath of vinylic copolymer at 500 g/l. The aqueous bath which has a pH of between 4.5 and 10 and a temperature of between 20° and 60° C., comprises the following ingredients:

| | |
|---|---|
| mixture of copolymer C (vinyl chloride-methyl acrylate (70–90 : 30–10) by weight) and of copolymer D in the mass ratio (3:10) | 100 parts by weight |
| acetate of ethyleneglycol monobutylether | 1 part by weight |
| opaquing agent ($TiO_2$) | 5 parts by weight |
| matting agent (colloidal silica) | 10 parts by weight |
| dyes (pigmentary) | 3 parts by weight |
| anti-foam agent | 0.2 part by weight |
| lubricating agent | 2 parts by weight |
| hydrosoluble perfume (leather) | 0.5 part by weight |

What we claim is:

1. A process for the preparation of an artificial leather composite material for decoration, coating and shaping, in which a support comprising cellulosic fibres is treated to a sequential series of baths, each comprising one of either an aqueous dispersion or a suspension of a macromolecular substance, said process comprising the successive steps of:

(a) subjecting the fibrous support to an aqueous dispersion bath of at least one binding agent thereby introducing said at least one binding agent into said fibrous support;

(b) impregnating the fibrous support by subjecting same to an aqueous bath containing at least one macromolecular substance chosen from the group consisting of acrylic polymers and copolymers, (c) coating the fibrous support by subjecting same to an aqueous bath containing at least one macromolecular substance chosen from the group consisting of vinylic and acrylic polymers and copolymers, to form an intermediate layer;

(d) coating the coated fibrous support by subjecting same to an aqueous bath containing at least one macromolecular substance chosen from the group consisting of vinylic and acrylic polyers and copolymers and at least one coalescence agent, to form a finishing layer;

wherein the ratio of the introduced said at least one binding agent to the fibrous support in step (a) is in the range of between 5 to 30 parts by weight of said at least one binding agent to 100 parts by weight of said fibrous support;

the ratio of the impregnated at least one macromolecular substance to the fibrous support in step (b) is in the range of between 5 to 25 parts by weight of the impregnated macromolecular substance to 100 parts by weight of the fibrous support;

the ratio of the coated macromolecular substance to the fibrous support in step (c) is in the range of between 5 to 10 parts by weight of the coated macromolecular substance to 100 parts by weight of the fibrous support;

and the ratio of the finishing layer to the coated fibrous support in step (d) is in the range of between 5 to 25 parts by weight of the finishing layer to 100 parts by weight of the coated fibrous support.

2. A process as claimed in claim 1 wherein the aqueous dispersion of step (a) comprises at least one additive chosen from the group consisting of dyes, retention agents, lubricating agents, gluing agents, anti-foam agents, perfumes and pH adjusting agents.

3. A process as claimed in claim 1, wherein the aqueous bath of step (b) comprises at least one additive chosen from the group consisting of dyes, gluing agents and anti-foam agents.

4. A process as claimed in claim 1, wherein the aqueous bath of step (c) comprises at least one additive chosen from the group consisting of mineral fillers, dyes and gluing agents.

5. A process as claimed in claim 1, wherein the aqueous bath of step (d) comprises at least one additive chosen from the group consisting of opaquing agents, matting agents, dyes, lubricating agents, anti-foam agents and perfumes.

6. A process as in claim 1, further comprising the step of subjecting the resultant material formed by step (d) to a mechanical treatment process for altering the appearance of at least one exposed surface of said material.

7. A process for the preparation of an artificial leather composite material for decoration, coating and shaping, in which a support comprising cellulosic fibres is treated to a sequential series of baths, each comprising one of either an aqueous dispersion or a suspension of a macromolecular substance, said process comprising the successive steps of:

(a) subjecting the cellulosic fibrous support to an aqueous dispersion bath of at least one of either an acrylic polymer or a copolymer, at a concentration range of 250 to 550 g/l, said dispersion further containing for 100 parts by weight of said cellulosic fibers, 0.5 to 5 parts by weight of a dye, 0.1 to 1 part by weight of a lubricating agent, 0.1 to 0.5 part by weight of an anti-foam agent and 0.1 to 4 parts by weight of a pH adjusting agent;

(b) impregnating the fibrous support by subjecting same to an aqueous bath containing at least one of either an acrylic polymer or a copolymer at a concentration range of 250 to 550 g/l, said aqueous bath further comprising for 100 parts by weight of said one of either an acrylic polymer or a copolymer, 0.5 to 12 parts by weight of a gluing agent, 1 to 10 parts by weight of a dye and 0.1 to 0.5 part by weight of an anti-foam agent;

(c) coating the fibrous support by subjecting same to an aqueous bath containing at least one of either a vinylic polymer or a copolymer at a concentration range of 250 to 550 g/l, said aqueous bath further comprising for 100 parts by weight of said one of either a vinylic polymer or a copolymer, 25 to 85 parts by weight of a mineral filler and 1 to 10 parts by weight of a dye, (d) coating the coated fibrous support by subjecting same to an aqueous bath containing one of either a vinylic polymer or a copolymer at a concentration range of 250 to 550 g/l, said aqueous bath further comprising for 100 parts by weight of said one of either a vinylic polymer or a copolymer, 0.1 to 1 part by weight of a coalescence agent, 0.2 to 10 parts by weight of an opaquing agent, 1 to 15 parts by weight of a matting agent, 1 to 15 parts by weight of a dye, 0.1 to 0.5 parts by weight of an anti-foam agent, 2 to 10 parts by weight of a lubricating agent and from 0 to 1 part by weight of a perfume.

8. A process as in claim 7, further comprising the step of subjecting the resultant material formed by step (d) to a mechanical treatment process for altering the appearance of at least one exposed surface of said material.

9. A process as in claim 1, wherein the concentration of said sequential series of baths is in the range of between 250 to 550 grams per liter.

10. An artificial leather composite material produced in accordance with the process of claim 7.

11. An artificial leather composite material produced in accordance with the process of claim 6.

12. An artificial leather composite material produced in accordance with the process of claim 8.

13. An artificial leather composite material produced in accordance with the process of claim 1.

* * * * *